United States Patent [19]

Michler et al.

[11] Patent Number: 5,039,200

[45] Date of Patent: Aug. 13, 1991

[54] REFLECTIVE SAFETY STICK FOR WALKING AND JOGGING

[75] Inventors: Linda B. Michler; Paul A. Michler, both of c/o P.O. Box 10684, Fort Smith, Ark. 72917; C. L. Baker, Gulfport, Miss.

[73] Assignees: Linda Michler; Paul Michler, both of Fort Smith, Ark.

[21] Appl. No.: 370,007

[22] Filed: Jun. 21, 1989

[51] Int. Cl.[5] ..... G02B 5/12

[52] U.S. Cl. ..... 359/517; 359/541

[58] Field of Search ..... 350/98, 97, 100, 102, 350/103, 105; 273/84 R

[56] References Cited

U.S. PATENT DOCUMENTS

| | | | |
|---|---|---|---|
| 2,269,029 | 1/1942 | Lounsbery | 350/98 |
| 2,561,228 | 7/1951 | Richey | 350/97 |
| 4,293,189 | 10/1981 | Morikawa | 350/105 |
| 4,340,273 | 7/1982 | Jack et al. | 350/105 |
| 4,489,943 | 12/1984 | Werft | 273/84 R |

*Primary Examiner*—Bruce Y. Arnold
*Assistant Examiner*—James Phan
*Attorney, Agent, or Firm*—Nixon & Vanderhye

[57] ABSTRACT

A safety stick for joggers and other pedestrians has a shaft with high reflectivity. A grip can be provided as one end of the shaft and a hard plastic cap at the other. A wrist strap is provided adjacent the grip, with a break away connection to the shaft. The high reflectivity of the shaft may be provided by reflective (e.g. silver) paint on the shaft covered with a coat of clear lacquer having reflective glass beads (e.g. microspheres at a ratio of about two parts beads to one part lacquer by weight). Alternatively, the shaft may be spirally wrapped with retroreflective tape and covered with a clear plastic tube (e.g. pvc shrink tubing). A clear lacquer is applied over the clear plastic shrink tube.

5 Claims, 1 Drawing Sheet

REFLECTIVE SAFETY STICK FOR WALKING AND JOGGING

BACKGROUND AND SUMMARY OF THE INVENTION

There are numerous accidents between vehicles and pedestrians at dusk or night due to the inability of drivers to properly see pedestrians. This is especially a difficulty for joggers who may be taking unusual pathways with respect to approaching vehicles. While pedestrians, including joggers, who wish to be visible at night time to approaching vehicles can wear reflective clothing, sometimes it is impractical to wear reflective clothing, and under some circumstances reflective clothing does not provide suitable visibility.

According to the present invention, a safety stick is provided for use by pedestrians to make the pedestrians more visible to approaching traffic. The safety stick not only makes the pedestrian highly visible, but can have other purposes as well. For example, the stick can be of sufficient length and strength so that it may be utilized as a walking stick, and/or the stick may be used for self-defense, for example if a jogger is attacked by a dog.

The safety stick according to the invention has a shaft with first and second ends. Preferably the shaft is a wooden dowel having a diameter of between about one-half inch and one inch (e.g. three-quarter inch), and a length that is great enough so that it is visible and can be used for other purposes. Typically, the length will be about 20 inches or more, e.g. about 24 inches when specifically designed to be used by joggers, and about 36 inches when specifically designed to function as a walking stick too.

At the first end of the safety stick a grip is provided. The grip may be a foam suede grip of the type that is conventionally available, typically formed by a dipping process. At the second end of the stick, an end cap can be provided, such as a hard plastic cap. Also it is desirable to provide a wrist strap adjacent the grip and connected to the shaft by connecting means. The connecting means preferably comprises a breakaway connection (e.g. a metal swivel connection) to effect detachment of the strap from the shaft should a tension force greater than a predetermined amount (e.g. about 5–20 pounds, particularly about 8 pounds) be applied, as a safety feature.

To provide the safety aspects of the stick, there are means for providing high reflectivity of the shaft so that it can be readily seen. This high reflectivity can be provided by a reflective color paint (e.g. two coats of silver paint) on the shaft, covered with a coat of clear lacquer having reflective glass beads therein. The glass beads typically would be microspheres with a ratio of about two parts beads to one part lacquer by weight. Alternatively, the high reflectivity can be provided by wrapping the shaft with retroreflective tape (e.g. in a spiral configuration), with plastic tubing over the tape. The plastic tubing may be a pvc shrink tube, and clear lacquer may be applied over the shrink tube.

It is the primary object of the present invention to provide a safety stick that is simple yet effective. This and other objects of the invention will become clear from an inspection of the detailed description of the invention, and from the appended claims.

DETAILED DESCRIPTION OF THE DRAWINGS

Figure 1:
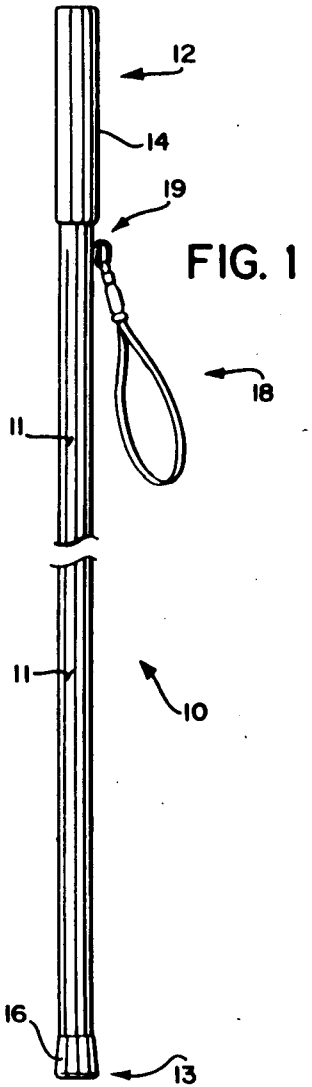
FIG. 1 is a perspective view of an exemplary safety stick according to the invention.

The safety stick according to the invention is shown generally by reference numeral 10 in FIGURE 1. The stick includes a shaft 11 having a first end 12 and a second end 13. The shaft 11 preferably comprises a wooden dowel having a diameter of about ½ inch-1 inch (e.g. about ¾ inch), and having a length sufficient to be effective for its designed purposes. The length typically would be at least about 20 inches, and if used primarily for joggers the length would preferably be about 24 inches, and where the stick 10 is primarily designed to be used as a walking stick the length would be about 36 inches.

At the ends of the stick 10 various end terminations are provided. At the first end 12 there preferably is provided a grip 14. The grip may be of any conventional type, but preferably comprises a foam suede grip, such as of the type that are commercially available, produced by a dipping process. The grip length would typically be about 6 to 7 inches from the end 12 toward the center of the shaft 11. At the second end 13, there preferably is provided a hard material cap, e.g. a hard plastic cap 16. The cap typically would have a length of about ¾ inch-1 inch from the end 13 toward the center of the shaft 11, and would cover the end of the shaft 11 and would facilitate use of the stick 10 for walking or the like.

Figure 4:
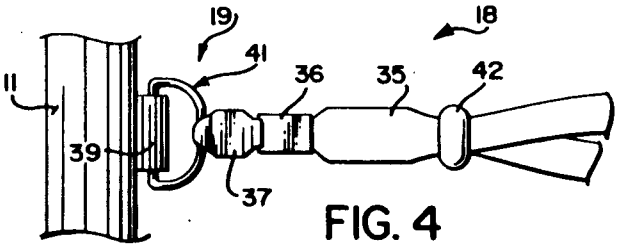
FIG. 4 is a detail enlarged view of the strap, and connection of the strap to the shaft, of the stick of FIG. 1.

There preferably also is provided a wrist strap shown generally by reference numeral 18 in FIGS. 1 and 4, adjacent to the grip 14 and connected to the grip by connection means 19.

In order to provide the safety function of the stick, there are means for providing high reflectivity of the shaft 11 so that it can be readily seen. Two exemplary highly utilitarian manners in which high reflectivity can be provided will now be described with respect to the embodiments of FIGS. 2 and 3.

Figure 2:
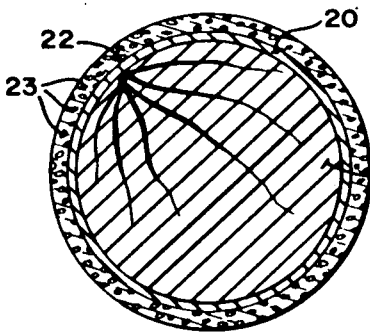
FIG. 2 is a cross-sectional view at the mid point of the stick of FIG. 1 showing one particular mechanism for lending high reflectivity thereto.

As shown in FIG. 2, the means for providing high reflectivity may comprise one or more coats of a reflective color paint 20 disposed on the immediate exterior of the shaft 11. For example, two coats of silver paint may be provided. Surrounding the paint layer 20 is a coat of clear lacquer 22 having reflective glass beads 23 therein. The glass beads 23 are commercially available, and are commonly known as "microspheres", and have high reflectivity. A particularly desirable reflective coating is provided when there are two parts beads to one part clear lacquer by weight.

Figure 3:
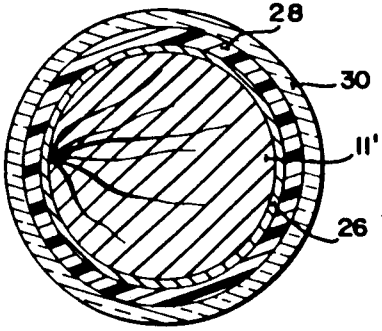
FIG. 3 is a view like that of FIG. 2 only for another exemplary embodiment.

In the embodiment illustrated in FIG. 3, a shaft 11' is shown with a highly reflective covering on it which is provided by retroreflective tape 26, clear plastic tube 28, and a clear lacquer coating 30. Preferably the retroreflective tape 26 is a highly reflective tape (e.g. about 500 candlepower reflectivity) such as sold commercially by 3M Company of Minneapolis, Minn., and it is wrapped around the outside of the shaft 11' in a spiral configuration. Plastic tube 28 preferably is a shrink tube, such as a pvc shrink tube. The tube is applied over the tape in one condition, and then the environmental condition is changed and the tube shrinks to tightly cover the tape, hold it against the shaft 11, and protect the tape from the environment. A coating of clear lacquer 30 on the plastic tubing 28 enhances its appearance, but is optional.

FIG. 4 illustrates the details of a strap 18 and breakaway connection 19 that may be provided according to the invention. The strap 35 comprises a conventional strap or cord, such as of leather, plastic, or the like, having a large loop that may be slipped around the user's wrist, a metal clip 36, and a short loop 37 on the opposite side of the metal clip as the main body/loop 35. Attached to the shaft 11 is a bushing 39. A metal swivel connection, formed by the bent metal rod 41, provides the connection means 19 between the shaft 11 and wrist strap 18, having portions that are received in both the loop 37 and the bushing 39. Bead 42 may be slid on loop 35 to adjust the size thereof. The metal rod 41 normally provides for swivel movement between the wrist strap 18 and the stick 11, however should a tension force greater than a predetermined amount be applied to the connection 41, it will break away. This provides an important safety feature, for should the stick be caught in something, the user will want the stick to detach from the user's wrist. The rod 41 preferably is engineered so that it will detach or break when a tension force of between about 5–20 pounds is applied, e.g. a tension force of greater than 8 pounds.

The safety stick according to the invention is simple to construct and manufacture, yet provides excellent visibility for the user, whether it is used as a walking stick, or whether it is held at a central portion thereof by a jogger. Also—in addition to its safety function—the stick has an ambulatory function (i.e. can be used as a walking stick), and also can be used for self-defense, for example where a jogger is attacked by an animal.

While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A safety stick comprising:

a shaft having first and second ends;

a grip at the first end of said shaft;

a wrist strap adjacent said grip and connected to said shaft by connecting means; and means for providing high reflectivity of said shaft so that it can be readily seen, said means comprising retroreflective tape wrapped around said shaft and PVC shrink tube over said tape.

2. A safety stick as recited in claim 1 wherein said grip comprises a foam suede grip.

3. A safety stick as recited in claim 1 wherein said means for providing reflectivity comprises retroreflective tape wrapped around said shaft, and plastic tubing over said tape.

4. A safety stick as recited in claim 3 wherein said reflectivity providing means further comprises a clear lacquer over said plastic tubing.

5. A safety stick as recited in claim 1 wherein said connecting means comprises a breakaway connection to effect detachment of said strap from said shaft should a tension force of about 5–20 pounds be applied.

* * * * *